US005616202A

United States Patent [19]

Camilletti et al.

[11] Patent Number: 5,616,202

[45] Date of Patent: Apr. 1, 1997

[54] ENHANCED ADHESION OF H-RESIN DERIVED SILICA TO GOLD

[75] Inventors: Robert C. Camilletti; Grish Chandra; Keith W. Michael, all of Midland, Mich.

[73] Assignee: Dow Corning Corporation, Midland, Mich.

[21] Appl. No.: 494,746

[22] Filed: Jun. 26, 1995

[51] Int. Cl.[6] ..... B32B 31/26; B05D 5/12

[52] U.S. Cl. ..... 156/89; 264/60; 264/61; 264/65; 29/831; 29/846; 29/851; 427/58; 427/96; 427/125; 427/126.2; 427/126.3

[58] Field of Search ..... 156/89, 278; 264/60, 264/61, 65; 427/58, 96, 125, 126.2, 126.3; 29/831, 846, 851

[56] References Cited

U.S. PATENT DOCUMENTS 3,969,570 7/1976 Smith .
4,050,956 9/1977 de Bruin et al. .
4,470,537 9/1984 Diem et al. .
5,039,552 8/1991 Riemer .
5,076,876 12/1991 Dietz .
5,387,480 2/1995 Haluska et al. .

OTHER PUBLICATIONS

M.A. George et al., "Thermally induced changes in the resistance, microstructure, and adhesion of thin gold films on Si/SiO2 substrates," J. Vac. Sci. Technol. A 8(3), May/Jun. 1990, pp. 1491–1497.

*Primary Examiner*—David A. Simmons
*Assistant Examiner*—M. Curtis Mayes
*Attorney, Agent, or Firm*—Roger E. Gobrogge; Sharon K. Severance

[57] ABSTRACT

Disclosed is a method of increasing the adhesion between gold and silica derived from hydrogen silsesquioxane resin. The method comprises joining the gold and silica followed by annealing under an oxidizing atmosphere.

20 Claims, No Drawings

ENHANCED ADHESION OF H-RESIN DERIVED SILICA TO GOLD

BACKGROUND OF THE INVENTION

The present invention relates to a method of increasing the adhesion between silica and gold. The method comprises joining the silica and gold followed by annealing in an oxidizing atmosphere.

It is well known that gold does not adhere well to ceramics such as silica. The reason for this lack of adhesion is the differences in bonding exhibited by these materials - i.e., silica adheres to substances by electrostatic bonds whereas gold adheres to substances by shared electron bonds. As such, a direct molecular bond between the materials is impossible.

It is often desirable in the electronics industry to use gold metallization and ceramic coatings on devices such as integrated circuits. However, because of the poor adhesion between these materials, delamination and circuit failure can occur.

Numerous approaches have been attempted to solve this problem. For instance, metallic oxides, metallic adhesion layers and adhesives have been applied between the ceramic and the gold to promote adhesion. These approaches, however, each have disadvantages such as cost, complexity, degree of adhesion, and electrical characteristics.

de Bruin et al. in U.S. Pat. No. 4,050,496, teach a simplified method of bonding comprising joining the ceramic and gold followed by heating in air. The reference teaches that the heating must be conducted at a temperature greater than about 800° C. to allow the materials to chemically react. As is obvious, however, this process is disadvantageous in that the high temperature may damage the substrate. Moreover, the silica described therein was not derived from hydrogen silsesquioxane resin.

The present inventors have now discovered that silica derived from hydrogen silsesquioxane resin can be bonded to gold by low temperature annealing in an oxidizing environment.

SUMMARY OF THE INVENTION

The present invention relates to a method of adhering silica to gold. The method comprises joining a gold article and a silica ceramic. The silica ceramic herein is formed by a process comprising heating hydrogen silsesquioxane resin to a temperature sufficient to form silica. The joined gold article and silica ceramic is then annealed in an oxidizing atmosphere at a temperature in the range of about 50°–500° C. for greater than about 1 hour.

DETAILED DESCRIPTION OF THE INVENTION

The present invention is based on the discovery that silica derived from hydrogen silsesquioxane resin ("H-resin") can be adhered to gold by low temperature annealing in an oxidizing atmosphere. This was particularly unexpected since the art teaches that this adhesion is not possible unless the silica and gold are annealed at higher temperatures. The inventors herein postulate that this unexpected discovery is based on the structure or properties of the H-resin and its interaction with the gold.

The first step in the process of the present invention involves joining a gold article and a silica ceramic. This joining can be accomplished in any manner desired. For instance, a gold object could simply be brought into contact with a silica object. Alternatively, the gold object could be formed or deposited in a manner such that it contacts the silica. For instance, a layer of gold could be deposited on a silica object by a vapor deposition or sputtering process. Finally, a silica object could be formed or deposited in a manner such that it contacts the gold. For instance, a layer of silica could be deposited on a gold object by a vapor deposition or spin-on process.

In a preferred embodiment of the present invention, the gold and silica are joined on an electronic device. As used herein, the expression "electronic device" is meant to include, but is not limited to, electronic circuits such as silicon based devices, gallium arsenide based devices, focal plane arrays, opto-electronic devices, photovoltaic cells, wiring boards and the like.

If the gold and silica are on an electronic device, the gold could, for example, take the form of thin film wiring, interconnects, or bond pads. Similarly, the silica could, for example, take the form of an interlayer dielectric or a passivating coating. In a more preferred embodiment of the invention, the gold is in the form of a bond pad and the silica is a passivating coating which is used to seal the electronic device.

The gold which is used herein can be very pure (eg. >99%) or, alternatively, it can be impure or doped with other elements such as metals, oxides, etc. This gold can be formed into any desired shape in any manner desired. Many techniques are known in the art. For example, the gold could be formed by vacuum deposition. This process involves placing the substrate to be coated in a vacuum chamber (having the desired pressure, temperature, plasma, etc,), evacuating the chamber, introducing a gold vapor into the chamber (formed by, for example, placing gold on a hot tungsten filament) and allowing the vapor to deposit on the substrate. Similarly, the gold could be sputtered, deposited by electron beam evaporation, deposited in molten form, and the like.

The silica which is used in the present invention is derived from hydrogen silsesquioxane resin. This resin is formed by the hydrolysis or partial hydrolysis of $HSiX_3$, wherein X is a hydrolyzable substituent such as a halogen (eg., chlorine, fluorine, bromine), an alkoxy (eg., methoxy, ethoxy, propoxy) or acyloxy (eg., acetoxy). The resultant resin has the formula $HSi(OH)_x(X)_yO_{z/2}$, in which each X is a hydrolyzable substituent as defined above, x=0–2, y=0–2, z=1–3, x+y+z=3. As such, the resin may be fully condensed $(HSiO_{3/2})_n$ or it may be only partially hydrolyzed (i.e., containing some Si—X) and/or partially condensed (i.e., containing some Si—OH). Although not represented by this structure, the resin may contain a small number (eg., less than about 10%) of silicon atoms which have either 0 or 2 hydrogen atoms attached thereto due to various factors involved in their formation or handling.

Methods for producing the resin are known in the art. For example, it is known to hydrolyze an alkoxy or acyloxy silane with water in an acidic, alcoholic hydrolysis medium. Similarly, Collins et al. in U.S. Pat. No. 3,615,272, which is incorporated herein by reference, teach the production of a nearly fully condensed H-resin (which may contain up to 100–300 ppm silanol) by a process comprising hydrolyzing trichlorosilane in a benzenesulfonic acid hydrate hydrolysis medium and then washing the resultant resin with water or aqueous sulfuric acid. Additionally, Bank et al. in U.S. Pat. No. 5,010,159, which is hereby incorporated by reference, teach an alternative method comprising hydrolyzing hydridosilanes in an arylsulfonic acid hydrate hydrolysis medium to form a resin which is then contacted with a neutralizing agent.

It is to be noted that in a preferred embodiment of the invention, specific molecular weight fractions of the above resin may be used. Such fractions and methods for their preparation are taught by Hanneman et al. in U.S. Pat. No. 5,063,267 which is hereby incorporated by reference. A preferred fraction comprises material wherein at least 75% of the polymeric species have a molecular weight above about 1200 and a more preferred fraction comprises material wherein at least 75% of the polymeric species have a molecular weight between about 1200 and about 100,000.

The silica may also contain other ceramic oxide precursors. Examples of such ceramic oxide precursors include hydrolyzed or partially hydrolyzed compounds of various metals such as aluminum, titanium, zirconium, tantalum, niobium and/or vanadium as well as various non-metallic compounds such as those of boron or phosphorous. These compounds are co-hydrolyzed with the H-resin and the mixed hydrolyzate pyrolyzed to form mixed ceramic oxide coatings as taught in U.S. Pat. Nos. 4,753,855 and 4,973,526, which are incorporated herein by reference.

The silica may also contain a platinum, rhodium or copper catalyst to increase its rate and extent of conversion to silica as taught in U.S. Pat. No. 4,822,697 which is incorporated herein by reference. Generally, any platinum, rhodium or copper compound or complex which can be solubilized will be functional. For instance, a composition such as platinum acetylacetonate, rhodium catalyst $RhCl_3[S(CH_2CH_2CH_2CH_3)_2]_3$, obtained from Dow Corning Corporation, Midland, Mich., or cupric naphthenate are all within the scope of this invention. These catalysts are generally added in an amount of between about 5 to 1000 ppm platinum, rhodium or copper based on the weight of hydrogen silsesquioxane resin.

The silica can be formed from the H-resin in any manner desired. For instance, the silica can be formed by chemical vapor deposition as taught in U.S. Pat. No. 5,165,955, which is incorporated herein by reference. Alternatively, the silica could be formed by a solution approach as described, for example, in U.S. Pat. No. 4,756,977 which is incorporated herein by reference. The latter approach is preferred and merely involves applying a liquid comprising the H-resin onto a substrate followed by heating.

If this solution approach is used, the H-resin liquid is generally formed by simply dissolving or suspending the H-resin in a solvent or mixture of solvents. Various facilitating measures such as stirring and/or heat may be used to assist in the dissolution/dispersion. The solvents which may be used in this method include, for example, aromatic hydrocarbons such as benzene or toluene, alkanes such as n-heptane, octane, decane or dodecane, ketones such as methylisobutylketone, cyclic dimethylpolysiloxanes, esters or ethers, in an amount sufficient to dissolve or disperse the above materials to low solids. For instance, enough of the above solvent can be included to form a 0.1–85 weight percent solution.

The substrate is then coated with this liquid by means such as spin, spray, dip or flow coating and the solvent is allowed to evaporate. Any suitable means of evaporation such as simple air drying by exposure to an ambient environment or the application of a vacuum may be used.

Although the above described methods primarily focus on using a solution approach, one skilled in the art would recognize that other equivalent means (eg., melt coating) would also function herein and are contemplated to be within the scope of this invention.

The H-resin is then typically converted to the silica ceramic by heating it to a sufficient temperature. Generally, the temperature is in the range of about 50° to about 1000° C. depending on the pyrolysis atmosphere and the preceramic compound. Preferred temperatures are in the range of about 50° to about 600° C. and more preferably 50–450° C. Heating is generally conducted for a time sufficient to ceramify, generally up to about 4 hours (eg., 1–3 hours), with less than about 2 hours being preferred.

The above heating may be conducted at any effective atmospheric pressure from vacuum to superatmospheric and under any effective oxidizing or non-oxidizing gaseous environment such as those comprising air, $O_2$, an inert gas ($N_2$, etc.), ammonia, amines, moisture, $N_2O$, etc.

Any method of heating such as the use of a convection oven, rapid thermal processing, hot plate, or radiant or microwave energy is generally functional herein. The rate of heating, moreover, is also not critical, but it is most practical and preferred to heat as rapidly as possible.

Again, the gold and the silica formed by the above processes are then joined. It should be noted that as used herein, this process does include applying hydrogen silsesquoxane resin to gold followed by converting it to silica.

In a preferred embodiment of the present invention, an integrated circuit having gold bond pads is sealed with a passivation coating of silica derived from hydrogen silsesquioxane resin. This is generally accomplished in one of two methods. In the first method, an integrated circuit is coated with the silica, the silica is etched at the bond pads and gold is deposited on the bond pads (and in contact with the silica). In the second method, gold is deposited on the bond pads of an integrated circuit followed by depositing a silica coating and etching it to expose the gold.

The joined gold and silica are then annealed in an oxidizing atmosphere. Generally, the temperature for annealing is in the range of about 50°–500° C. Preferably, the temperature is in the range of about 100°–200 ° C.

The method used for heating is not critical and any known in the art can be used herein. These include, for example, a convection oven, rapid thermal processing, hot plate, or radiant or microwave energy.

The time for the annealing is generally greater than about 1 hour. While the annealing may be performed as long as desired, for practical purposes the annealing time is generally in the range of about 1–24 hours with a time in the range of about 5–20 hours being preferred.

The atmosphere used for annealing is one which can oxidize the silica and the gold. These include, for example, environments such as air, $O_2$, oxygen plasma, ozone, nitrous oxide, etc. For simplicity, an atmosphere of air is generally used.

The resultant product has the silica firmly attached to the gold. These bonds have been strong enough to pass the Tape Adhesion Test of ASTM method B3330 using 33,618 pascal tape. Although not wishing to be bound by theory, Applicants postulate that the silica derived from H-resin has the capacity to interact and bond to the gold under the annealing conditions.

If desired, the silica coating may be covered by other coatings such as additional $SiO_2$ layers, silicon containing coatings, silicon carbon containing coatings, silicon nitrogen containing coatings, silicon oxygen nitrogen containing coatings and/or silicon nitrogen carbon containing coatings.

Such multiple layer coatings are known in the art and many are described in U.S. Pat. No. 4,756,977 which is hereby incorporated by reference. An especially preferred coating is silicon carbide applied by the chemical vapor deposition of silacyclobutane or trimethylsilane.

The following non-limiting examples are provided so that those skilled in the art may understand the invention more fully.

EXAMPLES

A 15 wt % solution of H-resin (made by the method of Collins et al. in U.S. Pat. No. 3,615,272) was prepared by dissolving the H-resin in cyclic dimethylsiloxanes (Examples 1–8) or n-heptane (Examples 9–10) and storing the mixture for 16 hours.

Silicon wafers, 125 mm diameter, were metallized by sputtering with 200 nm of gold and then exposed to 175° C. in nitrogen.

The wafers were subdivided into smaller groups to assess the impact of various surface cleaning techniques; 1) no cleaning, 2) UV ozone cleaning and 3) plasma cleaning (2 min. $O_2$+5 min. Ar).

The wafers were coated immediately after cleaning. The coating was applied by dispensing the H-resin solution though a 0.2 micrometer PTFE filter (point of use) directly onto the metallized wafers. The wafers were then spun at 3000 rpm for 20 seconds to obtain a thickness of approximately 350 nm.

All of the coatings were then converted into silicon oxide coatings by the following process:

1. The coated wafers were placed in a furnace and the temperature was ramped up to 175° C. in nitrogen.

2. The furnace was purged with anhydrous ammonia for 10 minutes.

3. Steam and ammonia was injected into the furnace for 4 hours.

4. The furnace was purged with anhydrous ammonia for 1 hour.

5. The temperature in the furnace was ramped down in anhydrous ammonia until the temperature was less than 100° C.

6. The furnace was purged with nitrogen.

The wafers with the silicon oxide coating were then subjected to the environments listed in Table 1.

The resultant coatings were then tested for adherence to the metallization by Tape Adhesion Test, ASTM method B3330 at 25° C. and 35% relative humidity. Three different adhesive strength industrial tapes were used in the tests:

1. 10,775 pascal
2. 24,998 pascal
3. 33,618 pascal

The results are presented in Table 1. Failure of the test is defined as delamination of the silica by the tape. It should be noted that the results of the surface cleaning are not presented since no variation in adhesion was detected from the different cleaning techniques.

TABLE 1

| Ex No | Environment | Result |
|---|---|---|
| 1 | As Made | fail-tape 1 |
| 2 | 3 weeks in nitrogen and 1 week in air at room temperature | fail-tape 1 |
| 3 | 100 hours at 121° C. and 100% relative humidity | fail-tape 1 |
| 4 | 100 hours of temperature cycling between 150° C. and −65° C. | pass-tape 3 |
| 5 | 50 hours of temperature cycling between 150° C. and −65° C. | pass-tape 3 |
| 6 | 24 hours at 150° C. in nitrogen | fail-tape 1 |
| 7 | 24 hours at 150° C. in air | pass-tape 3 |
| 8 | Test of Examples 3 and 4 combined | pass-tape 3 |
| 9 | As Made | fail-tape 1 |
| 10 | 24 hours at 150° C. in air | pass-tape 3 |

That which is claimed is:

1. A method of adhering silica to gold comprising:

joining a gold article and a silica ceramic, wherein the silica is formed by a process comprising heating hydrogen silsesquioxane resin to a temperature sufficient to form silica; and annealing the joined gold article and silica ceramic in an oxidizing atmosphere at a temperature in the range of about 50°–500° C. for greater than about 1 hour.

2. The method of claim 1 wherein the gold article comprises gold metallization on an electronic device.

3. The method of claim 1 wherein the gold article comprises a gold bond pad.

4. The method of claim 1 wherein the silica ceramic is a silica coating on an electronic device.

5. The method of claim 1 wherein the oxidizing atmosphere contains a gas selected from the group consisting of air, oxygen, ozone, nitrous oxide and oxygen plasma.

6. The method of claim 1 wherein the annealing is performed at a temperature in the range of between about 100° and about 250° C.

7. The method of claim 1 wherein the annealing is performed for between about 5 hours and about 24 hours.

8. The method of claim 4 wherein an additional ceramic layer is applied on the silica coating, wherein the additional ceramic layer is selected from the group consisting of $SiO_2$ coatings, silicon containing coatings, silicon carbon containing coatings, silicon nitrogen containing coatings, silicon oxygen nitrogen containing coatings and silicon nitrogen carbon containing coatings.

9. A method of adhering a silica coating to gold metallization on an electronic device comprising:

forming gold metallization on an electronic device;

applying a coating of hydrogen silsesquioxane resin on the electronic device, wherein the hydrogen silsesquioxane resin is deposited in physical contact with the gold metallization;

heating the electronic device to a temperature sufficient to convert the hydrogen silsesquioxane resin into a silica coating; and annealing the electronic device in an oxidizing atmosphere at a temperature in the range of about 50°–500° C. for greater than about 1 hour.

10. The method of claim 9 wherein the gold metallization comprises a gold bond pad.

11. The method of claim 9 wherein the oxidizing atmosphere contains a gas selected from the group consisting of air, oxygen, ozone, nitrous oxide and oxygen plasma.

12. The method of claim 9 wherein the annealing is performed at a temperature in the range of between about 100° and about 250° C.

13. The method of claim 9 wherein an additional ceramic layer is applied on the silica coating, wherein the additional ceramic layer is selected from the group consisting of $SiO_2$ coatings, silicon containing coatings, silicon carbon containing coatings, silicon nitrogen containing coatings, silicon oxygen nitrogen containing coatings and silicon nitrogen carbon containing coatings.

14. The method of claim 9 wherein the annealing is performed for between about 5 hours and about 24 hours.

15. A method of adhering gold metallization to a silica coating on an electronic device comprising:

applying a coating of hydrogen silsesquioxane resin on an electronic device;

heating the coated electronic device to a temperature sufficient to convert the hydrogen silsesquioxane resin into a silica coating;

forming gold metallization on the electronic device, wherein the gold metallization is in physical contact with the silica coating; and annealing the electronic device in an oxidizing atmosphere at a temperature in the range of about 50°–500° C. for greater than about 1 hour.

16. The method of claim 15 wherein the gold metallization comprises a gold bond pad.

17. The method of claim 15 wherein the oxidizing atmosphere contains a gas selected from the group consisting of air, oxygen, ozone, nitrous oxide and oxygen plasma.

18. The method of claim 15 wherein the annealing is performed at a temperature in the range of between about 100° and about 250° C.

19. The method of claim 15 wherein an additional ceramic layer is applied on the silica coating, wherein the additional ceramic layer is selected from the group consisting of $SiO_2$ coatings, silicon containing coatings, silicon carbon containing coatings, silicon nitrogen containing coatings, silicon oxygen nitrogen containing coatings and silicon nitrogen carbon containing coatings.

20. The method of claim 15 wherein the annealing is performed for between about 5 hours and about 24 hours.

* * * * *